United States Patent [19]

Maclean et al.

[11] 4,220,084

[45] Sep. 2, 1980

[54] DOCUMENT ENDORSER APPARATUS

[75] Inventors: George Maclean; Eddy J. Milanes; Harold W. Pexton, all of Oklahoma City, Okla.

[73] Assignee: Magnetic Peripherals Inc., Minneapolis, Minn.

[21] Appl. No.: 958,478

[22] Filed: Nov. 7, 1978

[51] Int. Cl.[3] ..... B41F 13/24

[52] U.S. Cl. ..... 101/235; 324/166; 324/172; 324/165; 235/926 A; 235/92 FQ; 101/248

[58] Field of Search ..... 101/232, 235, 233, 212, 101/93.12, 93.21, 93.29, 93.48, 111, 248; 324/160–161, 165, 166, 172; 235/92 FQ, 92 CA, 92 PS

[56] References Cited

U.S. PATENT DOCUMENTS

| | | | |
|---|---|---|---|
| 3,335,661 | 8/1967 | Moschetti et al. | 101/235 |
| 3,537,393 | 11/1970 | Hegi | 101/235 |
| 3,641,313 | 2/1972 | Watson | 101/235 X |
| 3,934,505 | 1/1976 | Kushner | 324/161 X |
| 3,944,923 | 3/1976 | Luteran | 324/165 |
| 4,021,681 | 5/1977 | Miesterfeld | 324/161 X |
| 4,023,489 | 5/1977 | Beery | 101/235 |
| 4,031,466 | 6/1977 | Krause et al. | 324/166 X |
| 4,074,196 | 2/1978 | Webster | 324/166 |
| 4,093,056 | 6/1978 | Burgers | 101/235 X |
| 4,133,262 | 1/1979 | Beery | 101/235 X |

OTHER PUBLICATIONS

"Verifying Tachometer Operation", IBM Technical Discl. Bulletin, vol. 14, No. 3, Aug. 1971, pp. 683–684.

*Primary Examiner*—Eugene H. Eickholt
*Attorney, Agent, or Firm*—Frederick W. Niebuhr

[57] ABSTRACT

As documents are moved serially past a servo motor-driven endorser, it endorses a stamp upon each. A transport signal dependent on document speed, and an endorser signal generated by an optical tachometer mounted to the servo motor, provide input to a frequency comparator. The output of the comparator is a control signal which controls the servo motor speed to adjust the endorser rotational surface velocity to equalization with the document speed. Logic circuitry sets the endorser at a zero angular position. Responsive to an endorse command, the endorser is accelerated to document speed, receives ink from a supply roller, then endorses the passing document. A counter and a digital comparator in cooperation with the tachometer signal completion of the endorsement whereupon the endorser is decelerated and placed in the zero position. Should a succeeding endorse command occur prior to complete deceleration, acceleration is resumed after a delay count given by a PROM and based upon the pulse count when the succeeding endorse command is received.

12 Claims, 11 Drawing Figures

DOCUMENT ENDORSER APPARATUS

BACKGROUND OF THE INVENTION

The invention relates to an apparatus for endorsing each of a series of moving documents.

The high volume of documents which must be handled in commerce has created a demand for means by which a large number of documents can be handled rapidly. This has led to the development of devices for performing routine operations such as sorting and endorsing. One type of apparatus for placing endorsements upon documents includes means for transporting documents along the path past a rotating endorser head or wheel. As the document passes the wheel, the wheel is brought into contact with the document and stamps the endorsement in ink thereon. One form of this device, shown in U.S. Pat. No. 3,537,393 to Hegi granted Nov. 3, 1970, utilizes clutches for engaging and disengaging the rotating print head to start and to stop rotation. The device is subject to wear and requires frequent field service. Another apparatus, wherein a solenoid moves the rotating endorser head into contact with the moving document, lacks the capability of accurate positioning. Consequently, a plurality of endorsements must be placed at random across the document face.

One improvement has been the provision of means to accelerate the head from an at rest state responsive to a document entering the endorser, enabling selective placing of an endorsement on the check. However, as documents are randomly spaced and can be of varying length, it was found necessary to bring the endorser wheel to a selected angular position prior to acceleration to the printing velocity. U.S. Pat. No. 4,023,489 to Beery granted May 17, 1977, discloses an apparatus in which this problem is avoided. If a subsequent endorse command is received during deceleration of the endorse head, deceleration is interrupted, a constant velocity is maintained by a constant voltage, then reacceleration is initiated by a ramp generator to bring the head to printing speed at the desired time. One problem with the Beery device is that the voltage ramp generator must be set to a predetermined top voltage equivalent to the printing velocity. Should the document transport velocity change, the ramp generator does not follow the adjustment. Consequently, blurred printing can result.

SUMMARY OF THE INVENTION

The invention relates to an apparatus for rapidly endorsing checks in a series, having the ability to instantaneously track deviations in document speed from its expected normal value. The apparatus includes a transport means for conveying documents along a path. A first signal means is provided to generate a transport signal which has a frequency depending upon a transport velocity of the documents. The apparatus further includes an endorser positioned for surface engagement with each document as it is so conveyed. Drive means rotate the endorser at an angular speed which yields a rotational surface velocity of the endorser. A second signal means is provided for generating an endorser signal. The endorser signal frequency depends upon the rotational surface velocity.

Comparator means are provided having, as inputs, said transport and endorser signals. The comparator means generates as an input to said drive means a control signal derived from a comparison of the frequencies of said transport and endorser signals. The control signal, responsive to a difference in said frequencies, causes said drive means to change the endorser surface velocity toward equalization with said transport velocity.

The preferred drive means includes a low inertia DC servo motor drivably connected to the endorser. A notable advantage in using the low inertia DC motor is the rapid acceleration attainable in response to the control signal. This acceleration is sufficiently rapid to enable placement of an ink supply roller between the print wheel and the transport path, resulting in the ability to supply fresh ink just prior to each endorsement.

The output frequency from a magnetic pick up transducer is the input to a first phase lock loop. A first phase locked loop is the preferred means for generating the transport signal. The transport signal is provided as an input to a second phase locked loop including a switching power amplifier, the DC servo motor, an optical tachometer connected to the servo motor, and a phase/-frequency comparator. The optical tachometer generates the endorser signal based upon the DC servo motor rotational speed which equals the rotational surface velocity of the endorser, i.e. the endorsing speed.

A phase/frequency comparator receives as input the output of the optical tachometer (the endorser signal) and the output of the first phase locked loop (the transport signal). The frequencies of the signals are compared and the output, based upon the frequency difference between the two input signals, is the control signal. The speed of the DC servo motor is based on the signal it receives from the switching power amplifier which, in turn, is based upon the comparator output. The comparator generates a signal which tends to correct the motor speed such that the tachometer signal frequency and first phase locked looped signal frequency are equal. This corresponds to equality between the rotational surface velocity of the endorser and the document speed. Thus, instantaneous changes in document velocity are immediately reflected in the endorser speed. This ensures clarity of the printed endorsement even though the document speed may not be stable.

The optical tachometer can further be used to place the endorser in a selected angular position prior to its receiving an endorse command. An index marker is positioned in one of the channels of the optical tachometer. In cooperation with logic circuitry, the DC servo motor rotates the endorser in a search speed substantially less than the endorsing speed until a transition from dark to light (reverse motion) signals that a zero angular position is reached and disables the DC motor. The endorse command is normally initiated with the endorser at this zero position. A counter accumulates the number of pulses generated by the tachometer, each pulse representing an incremental angular displacement of the printing wheel. With the starting position known, the position of the endorser at any time can be determined by the tachometer count. A command to decelerate the endorser is generated when the tachometer count at the counter compares with a set count value equivalent to the completion of document endorsement. No extrinsic sensing means is required to determine endorsement completion.

An advantageous application of the continuous position-monitoring capability of the optical tachometer occurs when an endorse command for a subsequent or trailing document is received before complete deceleration after an endorsement. Based upon the tachometer count stored in the counter when the subsequent endorse command is received, a programmable read only memory (PROM) effects a delay in endorser reacceleration. This is done in order to encounter the next document at the proper place. At the completion of the time delay, acceleration is resumed to bring the endorser to printing speed. The counter is reset to zero when the print head passes through the zero index position.

IN THE DRAWINGS

Other features and advantages will become apparent upon reading the following detailed description and upon reference to the following drawings in which:

FIG. 1 is an exploded perspective view of an endorsement apparatus in accordance with the present invention;

FIGS. 2A, 2B, and 2C, comprise a diagrammatic view of an optical tachometer of the invention shown in three operative positions;

DETAILED DESCRIPTION OF THE PREFERRED EMBODIMENT

Figure 1:
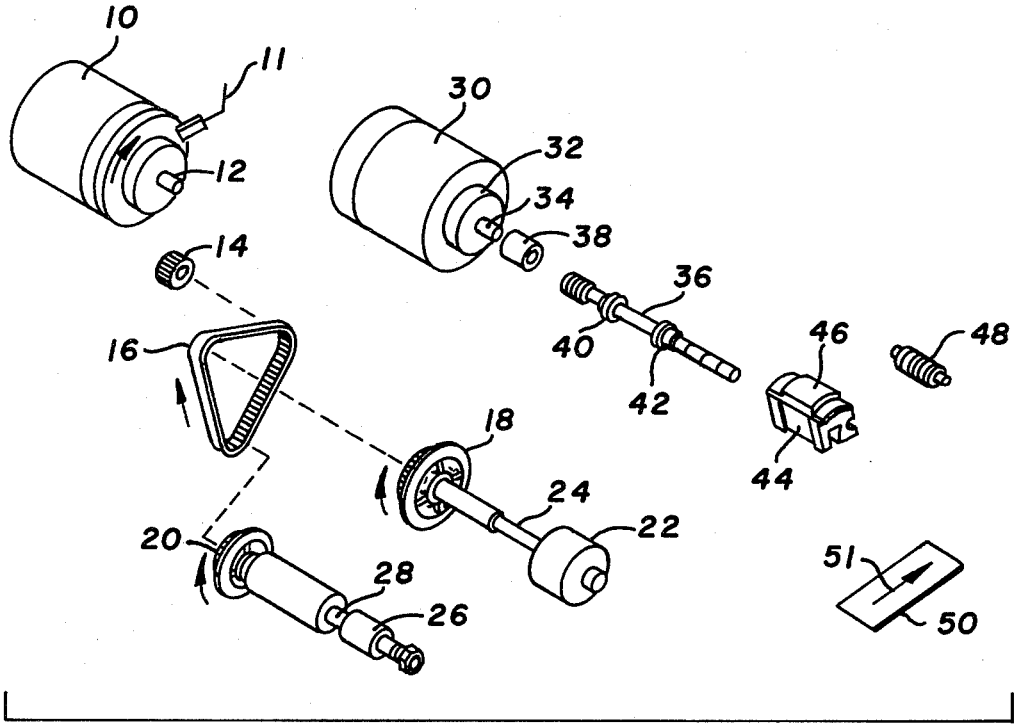

Turning to FIG. 1, there is shown in exploded perspective, an apparatus for endorsing documents, for example, checks. The endorser apparatus includes a transport means such as an AC motor 10 for conveying documents along a path through the apparatus. A magnetic pick up transducer 11 produces pulses that indicate the transport speed. A transport motor shaft 12 rotates in one direction as indicated by the arrow on motor 10. A first toothed pulley 14 is mounted to shaft 12 and drivably engages a drive belt 16. Also engaged with belt 16 are a second toothed pulley 18 and a third toothed pulley 20. A porous ink roller 22 is attached to pulley 18 through an ink roller shaft 24. A backup pressure roller 26, preferably urethane or another elastomer, is attached by a backup shaft 28 to pulley 20. Pulleys 18 and 20, together with rollers 22 and 26, are of a selected size such that the tangential or surface velocity of the rollers equals the speed at which documents are conveyed through the apparatus by a series of transport rollers located along the path and associated with transport motor 10. The transport rollers are not shown herein, as they are known in the art and not germane to the invention.

The endorsing apparatus further includes an endorser motor 30, which is a low inertia DC servo motor. An optical digital tachometer 32 is attached to motor 30. A servo motor shaft 34 drives an endorser head shaft 36 through a flexible coupling 38. Endorser shaft 36 is maintained on an axis perpendicular to the direction of document travel by a first mechanical bearing assembly 40 and a second mechanical bearing assembly 42. Attached to the outward end of shaft 34 is an endorser head or wheel 44, preferably of aluminum or other light weight and durable material. An endorser plate 46 is removably fastened to head 44, so that a variety of print logos can be applied by substitution of plates. A number wheel assembly 48, including six detented number wheels, is also removably mounted to head 44. The number wheels can be positionally adjusted for example, to show the correct date. Head 44, plate 46 and number wheel assembly 48, together comprise an endorser adapted to transfer indicia to a passing document or check 50, shown with an arrow 51 thereon to indicate the direction of document travel past the endorser wheel.

The endorser apparatus is activated by supplying power to AC transport motor 10. Responsive to this initial power supply, the DC servo motor, in cooperation with logic circuitry, places endorser head 44 in a selected "zero" angular orientation with respect to the document path. How this is accomplished is seen in FIG. 2, showing optical tachometer 32 in three separate positions prior to reaching the selected angular orientation called a "zero" position. Tachometer 32 includes a disc 49 mounted to shaft 34 for rotation with motor 30. Disc 49 can be glass or another transparent material. A series of lines of resolution 52 on disc 49 are located peripherally of the disc rotational center and spaced apart equally from one another. In the preferred embodiment, there are 500 lines of resolution in the 360 degrees of rotation about disc 49. A first photodetector 53 and a second photodetector 54 are positioned on the front of disc 49 opposite lines 52. A dark index mark 55, encompassing 65 degrees of rotation, is placed on the disc radially outward of lines 52. An index photodetector 56 is located adjacent and radially outward of photodetectors 53 and 54 for interaction with mark 55. On the opposite side of disc 49 is a light source 57. Whenever disc rotation carries index 59 between photodetector 56 and source 57, light transmission between them is prevented. Thus, the mark defines an angular "dark" region of 65 degress rotation, the remaining 295 degrees being a "light" region.

Figure 2A:
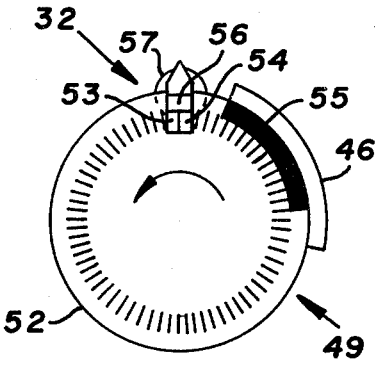

With power to the endorser apparatus and photodetector or sensor 56 opposite a light region as shown in FIG. 2A, a search command is initiated which causes DC servo motor 32 to rotate the head 44 and tachometer 32 in the forward direction or counter-clockwise as viewed in FIG. 2, at a rotational search speed equivalent to an endorser surface tangential velocity of about 16.3 cm per second. This forward rotation continues until the leading edge of index mark 55 reaches sensor 56, at which time a light-to-dark transition is perceived, which disables motor 30.

Figure 2B:
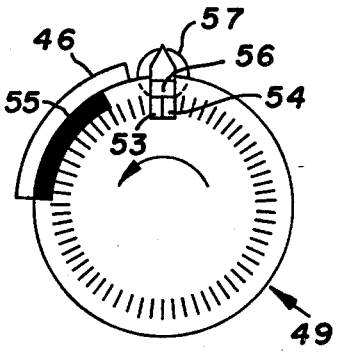

FIG. 2B also illustrates the situation where, when power is activated, sensor 56 is located opposite a light region. Once again, forward or counter-clockwise rotation is initiated in disc 49, and continues until a light to dark transition is perceived by sensor 56. In this case, more rotation is required; over 270 degrees.

In either case, the index photodetector, as soon as it no longer receives light from source 57, causes disabling of motor 30 to stop the endorser at the zero position; i.e. with the counter-clockwise edge of the index mark (as seen in FIG. 2) aligned with photodetector 56.

Figure 2C:
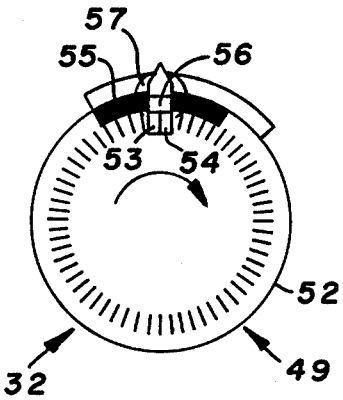

FIG. 2C shows a case where, when power is first supplied to the apparatus, index marker 55 is between sensor 56 and light source 57. In this case, reverse or clockwise rotation at search speed is caused in disc 49, until a dark-to-light transition is perceived, whereupon the DC motor is disabled. The endorser is stopped as soon as sensor 56 receives light. Regardless of the search direction, disc 49 does not rotate more than eight index lines 52 beyond the zero position, before it comes to a stop. This ensures that the maximum error in dislocation of disc 49 from its desired zero position is five degrees. Thus, index mark 55, sensor 56, and light source 57 comprise a means for aligning the endorser.

Figure 3:
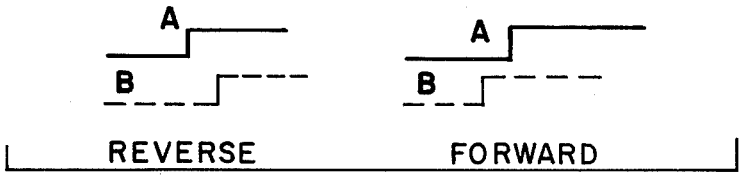
FIG. 3 is a timing diagram illustrating the use of two channels in determining direction from the tachometer.
Figure 4:
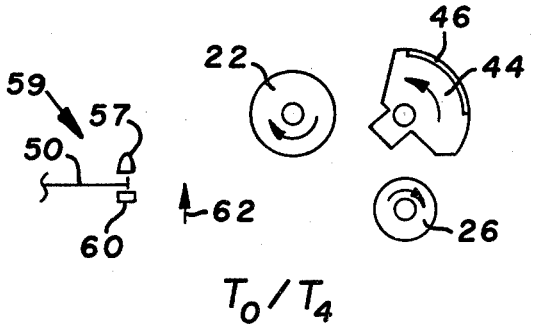
FIG. 4 is a diagrammatic representation of a printing wheel of the invention as an endorsement command is received, and indicates the zero rest position of the endorser.

FIG. 3 is a timing diagram which illustrates the use of lines 52, together with first and second photodetectors or sensors 53 and 54, to determine the direction in which disc 49 is rotating. Each of the 500 lines is positioned to momentarily interrupt light transmission between source 57 and sensor 53 when disc rotation carries it between the sensor and source, and further, to momentarily interrupt transmission between the source and sensor 54 when carried therebetween. A small transparent material in front of the sensors contains identical lines as 52. When the disc moves, light cancellations occur between the sensors and light source. Sensors 53 and 54 are positioned to generate out of phase square waves, preferably in 90 degrees ±27 degrees phase quadrature. Thus, in FIG. 3, a channel A (sensor 53 and lines 52) tachometer signal is indicated in solid lines and channel B (sensor 54 and lines 52) auxiliary tachometer signal is indicated in broken lines. Reverse motion causes channel 53 to slightly lead channel 54, while in forward motion, channel 53 slightly lags the channel of 54. Thus, the direction of rotation can be determined.

The endorse operation is best understood in viewing FIGS. 4 through 8. Shown schematically in the figures, a sensing transmitter/receiver pair 59, including a sonic transmitter 58 and sonic receiver 60 is located along the document path upstream of the endorser apparatus. Sensing pair 59 issues an endorse command upon sensing an approaching document, which is when the leading edge of document 50 reaches the pair and breaks communication between transmitter 58 and receiver 60. An endorse command initiates the application of high amperage (herein ten amperes) to the DC servo motor 30, which causes the acceleration of head 44.

Figure 5:
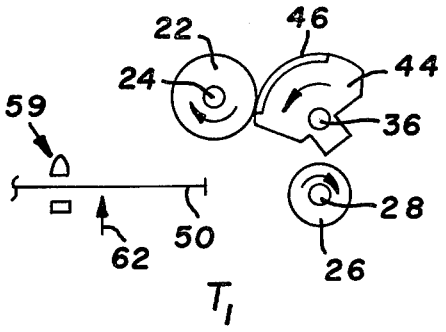
FIG. 5 is a diagrammatic view similar to FIG. 4 showing the endorser print wheel in contact with an ink supply roller.
Figure 6:
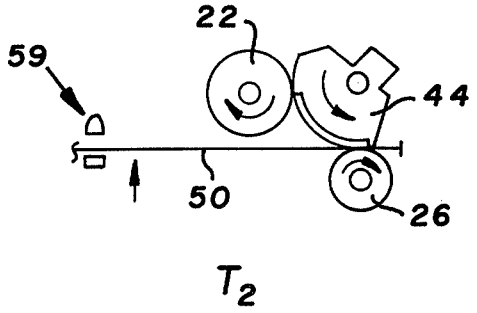
FIG. 6 is a diagrammatic view similar to that in FIG. 4 showing the initiation of document endorsement.

Because the system is low inertia, acceleration is quite rapid. By the time head 44 has reached ink supply roller 22 as shown in FIG. 5, it has been accelerated to print speed equivalent to an endorser tangential surface velocity of about 6.1 meters/second, equal to the document traveling speed. Consequently, the transfer of ink from roller 22 to plate 46 and number wheel assembly 48 occurs without frictional interference. By the time the leading edge of endorser wheel 44 has reached the document path, the document leading edge has already passed the endorser wheel leading edge. The precise distance from the document leading edge at which printing is desired can be set with reference to a commit point indicated by the arrow at 62. A distance between commit point 62 and endorser head 44 represents the delay inherent in the endorser mechanism such that if an endorse command was issued with the document leading edge exactly at commit point 62, printing would be at the document leading edge. The distance from the document leading edge to the point of intended printing is achieved simply by adding sufficient delay means, first of all, to accommodate the distance between point 62 and sensing pair 59, and then the desired distance of printing from the document leading edge.

Figure 7:
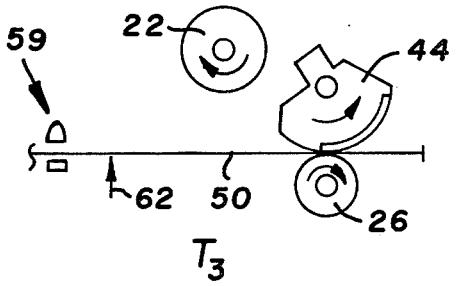
FIG. 7 is a diagrammatic view showing the completion of the endorsement.

FIG. 7 shows endorser head 44 in a final printing portion of the endorsement. This position can be known by counting pulses on the optical tachometer from the zero position shown in FIG. 4. In the preferred embodiment each of lines 52 represents one-half of a pulse. The count from initiation of the endorse command to the completion of the endorsement shown in FIG. 7, is 430 lines or 215 pulses. Using the tachometer, the completion of the endorsement is determined strictly by the pulse count following the endorse command. No auxiliary sensing means is required to determine that the endorsement has been completed.

Figure 8:
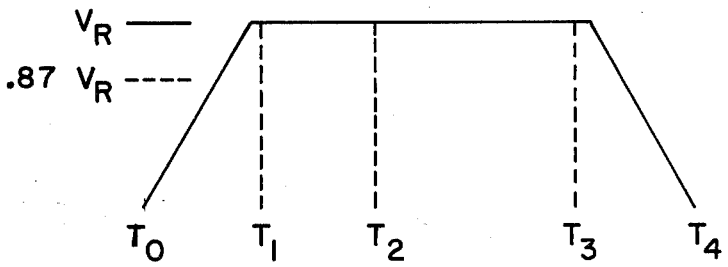
FIG. 8 is a diagram showing the endorser wheel velocity at selected times in the endorsement process.

FIG. 8 shows the rotational surface velocity profile of the endorser head 44. At $T_0$, the endorsement command is received. A high amperage (10 amperes) is applied to servo motor 30 whereupon a rapid acceleration takes place. As the velocity of the print head approaches a document transport speed, the amperage is switched from a high to a low amperage (approximately 3 amperes). This avoids an overshoot of a document speed. In the preferred embodiment, this amperage reduction occurs at 87 percent of document velocity. This velocity is achieved at $T_1$ prior to contact with ink supply roller 22. At $T_2$ the document 5 0 is encountered by endorser 44 and the endorsement begins. The endorsement of the document is completed at $T_3$, whereupon a counter indicates a stored count of 215 pulses which causes the deceleration in the print head toward zero velocity. If no subsequent document endorse command is received during deceleration, deceleration continues until the endorser head begins to rotate in the reverse direction. Reverse drive is removed and the endorser is placed in the search mode. The index sensor 56 commands the DC motor to move in reverse or forward direction depending upon whether or not the index mark 55 blocks the light to sensor 56.

Figure 9:
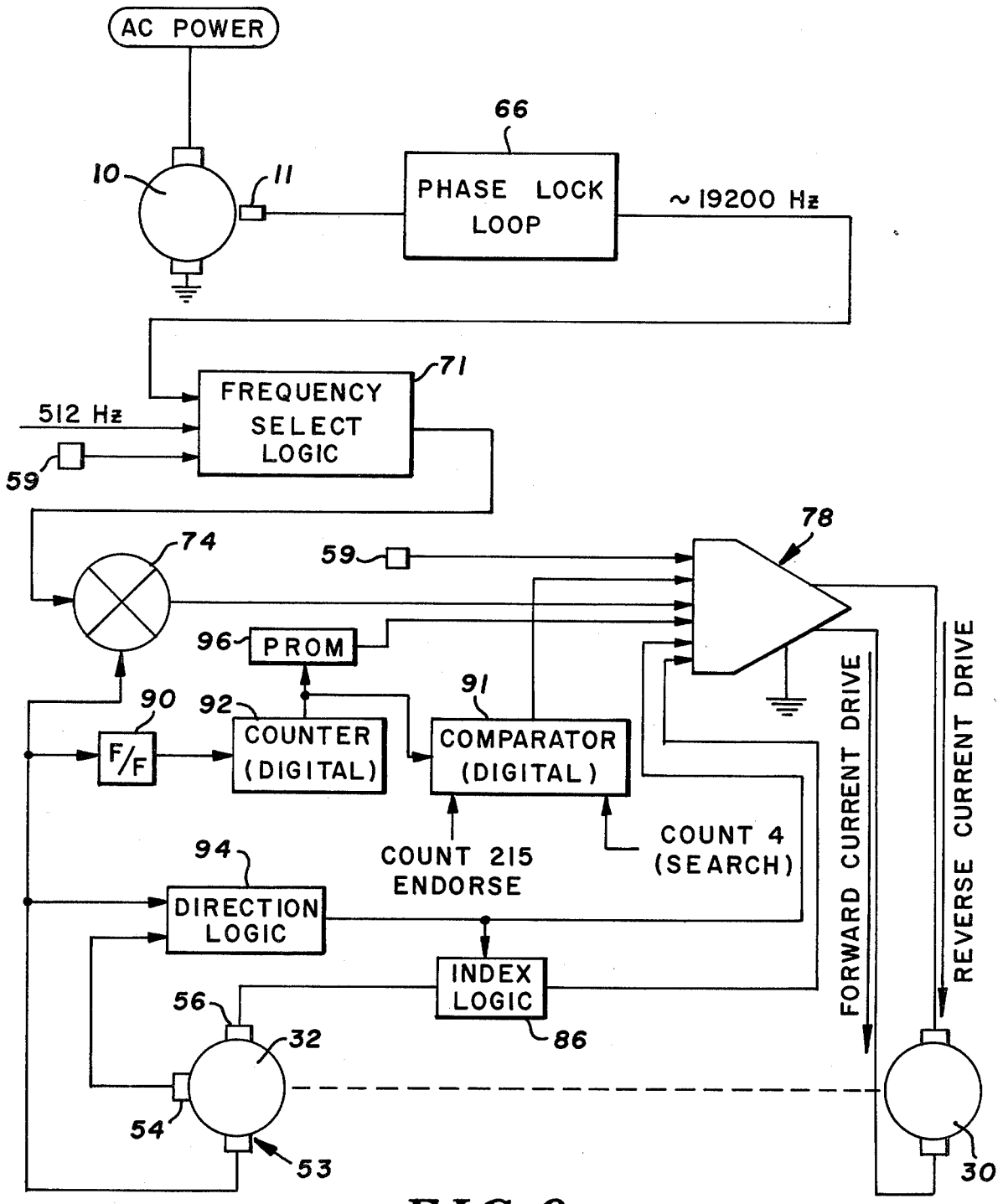
FIG. 9 is a block diagram showing circuitry of the endorser apparatus.

Circuitry of the endorsement apparatus is schematically shown in FIG. 9. A magnetic pick up transducer 11 is connected to the AC transport motor 10. The signal pulses from the magnetic pick up are fed to a phase lock loop 66 which has, as its output, a transport signal having a frequency which varies linearly with the velocity of transport motor 10. The transport signal is transmitted to a frequency select logic 71. The frequency of the transport signal is preferably 19200 HZ, but varies with fluctuations, if any, in motor 10. The signal is transmitted and compared in a phase/frequency comparator 74 with the signal from the optical tachometer 32. An error signal is generated by the phase comparator to a switching power amplifier 78 and logic circuitry associated therewith. The output of amplifier 78 causes the DC servo motor 30 to accelerate the endorser head 44 to a rotational velocity equal to the document transport speed.

The search mode is operative when a much lower reference frequency (herein 512 HZ) is transmitted through frequency select logic 71. This signal is also compared with the tachometer signal by phase comparator 74. The error signal drives the power amplifier which in turn moves the motor at the search speed. The search and zero positioning of head 44 is completed under this low reference frequency, provided that a post endorsement deceleration is completed before a succeeding endorse command is received.

Upon receiving an endorse command, the high frequency signal is transmitted through logic 71 to frequency/phase comparator 74. At comparator 74, the high frequency signal is compared with the signal from the tachometer. An error signal is generated and transmitted as explained above, ultimately to DC servo motor 30, which is driven at an angular acceleration that varies linearly with the output current from amplifier 78. Thus, the current initiates rapid acceleration of the motor. Optical tachometer 32 generates a tachometer signal, with a frequency proportional to the rotational velocity of motor 30. This tachometer signal is an input to comparator 74. As long as the transport signal frequency and the tachometer signal frequency are equal, the velocity of motor 30 is maintained by a steady control from the comparator 74 to amplifier/logic 78. However, should there be a change in transport speed, the frequency of the transport signal changes as well. The change is immediately recognized in comparator 74, which modifies the control signal. In this manner, motor 30 can track the document speed so that an endorsement is placed upon a document at its transport speed.

The search mode is initiated by a command to logic 71 when transport power is switched on, and before any endorse command is received. The control signal from comparator 74 acts through amplifier 78, causing motor 30 to accelerate from stop until reaching search speed, when the endorser signal frequency equals the reference signal frequency. An index logic 86 samples tachometer 32 to determine whether or not index photosensor 56 is opposite index mark 55. If so, index logic 86 signals amplifier and logic 78 to operate motor 30 in the reverse direction; if not, the forward direction. Then zero positioning is accomplished as described in connection with FIG. 2. When disc 49 reaches the zero position, index 86 disables amplifier 78.

An exception to the usual search mode occurs if the endorser is rotating at a significant forward speed much higher than search speed when power is first switched on. This occurs if power is switched on when endorser head 44 is in contact with ink roller 22 or back up roller 26. Direction sensing logic 94 senses the rotational direction as explained in connection with FIG. 3, and together through index 86, signals amplifier 78 to generate full reverse power to motor 30 when the dark region is sensed by index sensor 56. Full reverse power is applied only over the dark region, since the endorse head is then not in contact with either of rollers 22 and 26. Under full reverse power, the endorse head is rapidly decelerated, at which time the low speed search mode is initiated.

A divide-by-two flip-flop 90 is connected between tachometer 32 and counter 92. Due to flip-flop 90, every two consecutive marks 52 which interrupt light transmission between source 57 and sensor 53 generate one pulse in counter 92.

Block 94 represents the direction detection logic. The inputs to this logic are the channels A and B of optical tachometer 32. They work as explained in FIG. 3 to indicate direction of rotation of motor 30.

Counter 92 is cleared when the zero index position is detected and counts pulses as head 44 is rotated from its zero position. As endorser head 44 moves forward in response to the endorse command, counter 92 accumulates the pulses to a count of 215 pulses (430 of the 500 lines). This represents sufficient angular rotation of endorsement head 44 such that the endorsement is completed. A comparator 91 compares the counter with a reference count of 215. At this count a signal is initiated to apply the full 10 amperage power in the reverse direction, causing a rapid deceleration in endorser head 44. If no subsequent endorse command is received, the deceleration continues until head 44 begins to rotate in the reverse direction. At this time reverse drive is disabled and the endorser is placed in the search mode to look for the zero index sensor. If the tachometer disc index mark 55 covers sensor 56, reverse drive is maintained until a dark to light transition is seen. Forward search is initiated when the light portion of disc 49 is in front of 56. A light to dark transition indicates the zero index position. In each of these cases, the counter 92 is reset to the count of zero.

If documents are sufficiently close to one another, a subsequent endorsement command is received prior to complete deceleration. In this event, a programmable read only memory (PROM) 96, connected to counter 92, takes a reading of the count accumulated in counter 92 at the time of such subsequent endorsement command. Based on this count, a delay is initiated between deceleration, which has begun since the preceding endorsement is complete, and a full forward amperage to motor 30. Since the exact angular position of motor 30 and head 44 is determined from the pulse count in counter 92, PROM 96 simply selects a delay based on the count. The result is application of forward drive to motor 30 at the exact time required to reaccelerate endorser head 44 and to place it in proper angular orientation for the endorsement of the succeeding document at the preselected distance from its leading edge.

What is claimed is:

1. Document endorsing apparatus including:

transport means for conveying documents in series along a path; first signaling means for generating a transport signal having a frequency varying linearly with a transport velocity of said documents; an endorser positioned for surface engagement with each of said documents as it is so conveyed; drive means for rotating said endorser; second signaling means for generating an endorser signal having a frequency varying linearly with a rotational surface velocity of said endorser; a phase/-frequency comparator for generating, as an input to said drive means, a control signal response to the difference in frequency between said endorser and transport signals whereby said drive means, responsive to said control signal, varies said surface velocity toward equalization with said transport velocity; sensing means for generating an endorse command upon sensing the leading edge of each document at a point along said path upstream of the endorser, said drive means, upon receiving said command, accelerating the endorser to said surface velocity prior to surface engagement with each document sensed; delay means connected between said sensing means and drive means to interrupt said endorse command a selected amount of time whereby an endorsement is placed upon the document a selected distance from its leading edge; an alignment means for positioning said endorser in a select angular position before said drive means receives said endorse command, said alignment means including a transparent disc mounted for rotation with said endorser, a light source and an index photosensor on opposite sides of the disc, and an opaque index mark on the disc adapted to prevent light transmission from the source to said index photosensor to define peripherally a dark angular region and a light angular region wherein light transmission is permitted; and search means for actuating said drive means whereby the endorser is rotated at a search velocity substantially less than said surface velocity, said search means disabled to stop the endorser responsive to a transition from one of said angular regions to the other.

2. The apparatus of claim 1 wherein:

said search means actuates the drive means in a forward direction responsive to the sensing of said light region, and in a reverse direction responsive to the sensing of said dark region.

3. The apparatus of claim 1 including:

first and second photodetectors on the opposite side of said disc from said light source, and means defining in said disc a plurality of equally spaced lines, each line positioned to momentarily interrupt light transmission between the first photodetector and light source as it is carried by disc rotation therebetween, and to momentarily interrupt light transmission between the source and said second photodetector, pulses transmitted by said first and second photodetectors being equal in frequency but out of phase thereby to indicate the direction of endorser rotation.

4. The apparatus of claim 3 including:

a counting means for accumulating a count proportional to the momentary interruptions between said light source and first photodetector to measure the angular displacement of the endorser.

5. The apparatus of claim 4 wherein:

the counting means is cleared responsive to said endorse command following said positioning by said alignment means, accumulates a count as said endorser is rotated forward responsive to said endorse command, and causes deceleration of the endorser responsive to the accumulation of a count equivalent to the amount of angular displacement necessary to complete endorsement.

6. The apparatus of claim 5 including:

delay selection means; responsive to the generation, during endorser deceleration, of a succeeding endorse command for a succeeding document; for reading the count in said counting means at the time of said succeeding endorse command and, in accordance with said count, interposing a delay of the succeeding command and accompanying endorser reacceleration whereby the succeeding document is endorsed at said selected distance from its leading edge.

7. The apparatus of claim 6 wherein:

said delay selection means includes a programable read only memory.

8. The apparatus of claim 1 including:

an ink supply roller rotating at the transport velocity and positioned for surface engagement with the endorser as it rotates forward from said select angular position toward surface engagement with a document to be endorsed, said drive means accelerating the endorser to said surface velocity prior to its engagement with the ink roller.

9. The apparatus of claim 8 wherein:

the drive means includes a low inertia d.c. servo motor.

10. The apparatus of claim 1 wherein:

said first signaling means includes a phase-locked loop connected between said transport means and said comparator.

11. The apparatus of claim 1 including:

a first photodetector on the opposite side of said disc from said light source, and means defining in said disc a plurality of equally spaced lines, each line positioned to momentarily interrupt light transmission between said first photodetector and said light source as it is carried therebetween by rotation of said disc, the frequency of said endorser signal being proportional to the frequency of interruptions.

12. The apparatus of claim 11 including:

a second photodetector on the opposite side of said disc from said light source and spaced apart from said first photodetector to generate an auxiliary endorser signal equal in frequency to said endorser signal but out of phase therewith, thereby to indicate the direction of endorser rotation.

* * * * *